US007819294B2

(12) United States Patent
Lowe et al.

(10) Patent No.: US 7,819,294 B2
(45) Date of Patent: Oct. 26, 2010

(54) GUN HOLSTER

(75) Inventors: Michael V. Lowe, Boise, ID (US); Anthony J. Senn, Nampa, ID (US)

(73) Assignee: Tactical Design Labs, Inc., Boise, ID (US)

( * ) Notice: Subject to any disclaimer, the term of this patent is extended or adjusted under 35 U.S.C. 154(b) by 290 days.

(21) Appl. No.: 11/057,070

(22) Filed: Feb. 11, 2005

(65) Prior Publication Data

US 2005/0279788 A1 Dec. 22, 2005

Related U.S. Application Data

(63) Continuation-in-part of application No. 10/877,780, filed on Jun. 25, 2004, now Pat. No. 7,584,875.

(60) Provisional application No. 60/482,824, filed on Jun. 25, 2003.

(51) Int. Cl.
*F41C 33/02* (2006.01)

(52) U.S. Cl. ..... 224/243; 224/193; 224/912

(58) Field of Classification Search ..... 224/192, 224/193, 196, 243, 244, 912; 200/43.13, 200/43.18

See application file for complete search history.

(56) References Cited

U.S. PATENT DOCUMENTS

| | | | | | |
|---|---|---|---|---|---|
| 2,551,913 | A * | 5/1951 | Toby | 224/244 |
| 2,673,259 | A * | 3/1954 | Appleton et. al. | 200/43.13 |
| 2,708,537 | A * | 5/1955 | Dec | 224/196 |
| 3,669,325 | A * | 6/1972 | Furman | 224/243 |
| 4,277,007 | A * | 7/1981 | Bianchi et al. | 224/193 |
| 4,496,811 | A * | 1/1985 | Irwin | 200/86.5 |
| 4,971,236 | A * | 11/1990 | Grummet | 224/243 |
| 5,150,913 | A * | 9/1992 | Hoelzl | 280/612 |
| 5,275,317 | A * | 1/1994 | Rogers et al. | 224/244 |
| 5,421,497 | A * | 6/1995 | Gilmore | 224/198 |
| 5,467,909 | A * | 11/1995 | Resca et al. | 224/244 |
| 6,538,221 | B1 * | 3/2003 | Nishimoto et al. | 200/334 |
| 6,588,640 | B1 * | 7/2003 | Rogers et al. | 224/673 |
| D501,991 | S * | 2/2005 | Cook et al. | D3/222 |
| 6,948,644 | B1 * | 9/2005 | Beletsky | 224/193 |
| 2002/0070253 | A1 * | 6/2002 | Beletsky et al. | 224/192 |
| 2002/0134803 | A1 * | 9/2002 | Lowe et al. | 224/243 |

* cited by examiner

*Primary Examiner*—Justin M Larson
(74) *Attorney, Agent, or Firm*—Robert L. Shaver; Dykas, Shaver & Nipper, LLP

(57) ABSTRACT

The invention includes improvements to a security holster including protective ridges for use around the release mechanism and the locking mechanism. Also included is a mortise and tenon arrangement for securing the holster body to a belt attachment plate.

3 Claims, 6 Drawing Sheets

GUN HOLSTER

PRIORITY

This application claims priority from and is a continuation-in-part of the utility application entitled "Gun Holster" filed by Lowe, et al. on Jun. 25, 2004 with application Ser. No. 10/877,780, now U.S. Pat. No. 7,584,875 which claims priority from the provisional patent application entitled "Security Holster" filed by Lowe, et al. on Jun. 25, 2003 with application Ser. No. 60/482,824, which are incorporated herein by reference.

BACKGROUND OF THE INVENTION

1. Field of the Invention

The present invention generally relates to handgun holsters, and more particularly relates to holsters which provide security against unauthorized withdrawal of a handgun.

2. Background Information

Police, security officers, and military personnel in a number of situations must be ready to withdraw and use a handgun in the line of duty at a moment's notice. In an emergency situation, withdrawing the handgun must be done in a completely natural and unobstructed manner so that it can be withdrawn as quickly as possible. The officer's life may depend on the speed with which he can withdraw the handgun. However, after the handgun is withdrawn, the situation may dictate other options or needs, requiring the officer to re-holster the handgun just as quickly. Current holsters do not meet this demand, without some continued manipulation of security straps, before the officer knows or has confidence that the weapon is secure. In this type of situation, the officer needs to be able to holster his handgun with one hand without looking at the holster, and while maintaining eye contact with the person in question.

The problem results when a suspect becomes an assailant, and attacks the officer and tries to gain access to his weapon. In the event of an attack, a holster is likely to be bumped, jostled, pried, and pressured with forces exerted on nearly any part of the holster. Some holsters have release mechanisms that may be accidentally engaged during such an assault, releasing the weapon from the effective grip of the holster. When an assailant attacks, it is of utmost importance that the officer maintains control of his handgun, and that the assailant does not get access to the handgun. Many holsters have been designed to accomplish this purpose in a number of different manners. However, they all suffer a number of drawbacks. Some require two hands to release and secure the handgun. This is unacceptable. Some of them secure the handgun with a device that can be difficult to release in a fast draw situation, and therefore is a dangerous security mechanism. Some holsters secure the weapon in place to keep it from bouncing out of the holster, but are not designed to withstand the attack of an assailant and would allow the handgun to be taken from the officer by the assailant. Some holsters use electronic devices for fingerprint recognition and run the risk of malfunctioning or having a dead battery. Some holsters require the user to tilt or rock the handgun, or twist it before it can be released from the handgun. Such a maneuver must be practiced frequently in order to ensure that the wearer can perform it without mistake in an emergency situation. Many of the holsters are unable to address the above-mentioned problems or provide a security holster for a left-handed user. Additionally, many holster using groups desire to have a uniform pattern for their equipment. Some groups use specific patterns and symbols to identify a user's equipment and identity. Most security holsters provide no manner in which the holsters can be customized or individualized for an individual or specific group. All of the above named difficulties are problems that face a security holster user, and an improved security holster is needed which solves these problems.

For these reasons, it is an object of the present invention to provide a security holster for a handgun for use by left-handed and right-handed users which allows a handgun to be quickly inserted or withdrawn with one hand, without looking at the holster, and which secures the holster to the officer without undue manipulation of the handgun. It is a further goal of the invention that the security holster and corresponding locking and releasing mechanisms provide protection against accidental release due to an accident or during an assault on the wearer. It is a further goal of the invention that the security holster not allow an assailant to withdraw the handgun against the will of the officer. It is a further object of the invention to provide a handgun securing holster which is easily released by a natural and fluid motion of the officer whether left or right-handed. It is a further object of the invention to provide a security holster which may be fluidly inserted or removed from the holster. Another object of the invention is to provide a security holster which may be effectively customized with adhesive inlays for standardization and matching purposes. Another object of the invention is to require a minimum compression force that must be exerted on the security holster in order to engage and disengage the locking mechanism for a handgun.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

One embodiment of the holster is specifically for left-handed users of a semi-automatic handgun. It includes a holster body. The holster body includes inner and outer rigid sidewalls that are spaced apart to define an inner cavity. The inner cavity has an open top portion into which the handgun is inserted. The top portion is also identified as the rear of the holster. The portion of the holster that is adjacent to the end of the handgun barrel is designated as the front or bottom of the holster. The holster also includes a locking means, which is designed to allow the handgun to pass by it. When the handgun is seated in the holster, the locking means is designed to engage a feature of the handgun, thereby preventing the withdrawal of the handgun prior to the release of the locking means. The security holster also includes a releasing means, which is mounted so that when a handgun is inserted within the holster, the releasing means is adjacent the right side of the handle of the handgun. In this version of the holster, the releasing means is configured for activation by movement of a user's left thumb. The releasing means is a release tab that is depressed by a left-handed user's left thumb as he/she reaches for the handgun. When the user's hand is on the handle of the handgun, the release tab is positioned directly below his/her thumb over the right side of the handgun handle. The release tab is operationally connected to a locking tab, and when the release tab is pressed down, the locking tab disengages from the handgun feature and allows the handgun to be withdrawn.

This version of the holster provides for one-handed insertion of the handgun into the security holster. When a handgun is pressed into the holster, the locking tab engages a handgun feature such as a trigger guard, the slide, or preferably an ejection port. This engagement prevents the handgun from being withdrawn until the release tab is activated by the left-handed user's left thumb.

The locking tab is a generally planar projection that extends from an arm connected to the release tab. The locking tab is configured to move from an open position that allows entry of the handgun without the handgun touching the locking tab, into a closed position in which the locking tab engages a feature of the handgun. The locking tab can be activated to move into engagement with the handgun feature such as the ejection port by compression of one or more springs built into the holster. Preferably, the locking tab passes through the ejection port on the slide of the semi-automatic handgun and locks under the ejection port on the slide, adjacent the barrel of the handgun. Alternatively, any feature of the slide could also be utilized because not all models of handguns have a space under the ejection port that can be utilized. Once engaged, the locking tab is typically pressed into engagement with the handgun feature by a spring, which is compressed during insertion into the holster.

The release tab of the holster is typically an elongated tray, which is configured for sliding engagement with the left-handed user's left thumb. The elongated tray extends from over the trigger guard to partially over the handle of the handgun, which allows the left-handed user to activate the release tab with his/her left thumb.

Another feature of this configuration of the device is that the locking tab engages the handgun feature with an audible indication of locking. This is typically a distinctive click, which in most environments can easily be heard and is a certain indication to the user that the handgun is engaged in the holster. The locking tab engages with sufficient force so that there is also a tactile indication of locking, which the user may feel through the handle of the handgun or through the body of the holster into his/her hip region. This version of the holster typically includes a pressure switch, which activates the locking means when the handgun is pressed into the holster with a required degree of insertion force. The pressure switch, also called a rebounding device, also operates with the releasing means, and a minimum degree of insertion force is required before the handgun is released.

Other embodiments of the security holster can include left or right-handed versions. A feature of one embodiment of the security holster is that the locking mechanism does not contact the slide of the gun as the gun is inserted into the holster. This is accomplished because the locking tab rests against the outside of the security holster until the locking tab is moved laterally, at which time a torsion spring causes the locking tab to rotate down and engage a feature of the handgun, such as an area between the slide ejection port and the barrel of the handgun. Lateral movement of the locking tab is caused by downward pressure from the handgun. Similarly, to release the handgun, downward pressure of the handgun is required so that the locking tab again moves laterally and clears the ejection port of the holster and may be raised away from the handgun by pressing the release tab.

A distinctive feature of the holster is that one action is utilized to seat the handgun and secure it in the holster. This action is pressing the handgun down. Seating it in the locking mechanism of the holster is clearly indicated by an audible click of the locking tab, and can also be felt through the user's hand or holster. Three actions are required to remove the handgun from the holster. These three actions are: (1) pushing the gun down, (2) depressing the release tab, and (3) lifting the handgun out of the holster while depressing the release tab for a certain portion of the withdrawal.

Another feature of one embodiment of the present invention is that the locking mechanism includes a generally U-shaped rod. The rod has a right side, a left side, and a joining piece, which together forms a U-shape. The joining piece passes through a pair of slots or notches in the inner and outer side of the holster, and the left and right side of the U-shaped rod are attached to the holster, but are configured to move laterally in relation to the holster, parallel with the long axis of the holster. Typically, they are attached to the holster by bosses or guides on the left and right hand side. Preferably, one spring is utilized on both sides of the U-shaped rod, which urge the U-shaped rod toward the rear of the holster.

When a handgun is inserted into the holster, the front of the handgun contacts the joining piece of the U-shaped rod. Continued pressure on the handgun pushes the U-shaped rod forward, and the joining piece moves in two slots on the front of the handgun. When the handgun is pressed down, the two springs on either side of the U-shaped rod are compressed, and when the handgun is released, these springs press the handgun toward the rear or open end of the holster.

Also attached to the U-shaped rod is a locking tab. The locking tab is preferably urged to rotate toward the barrel of the gun by attachment to one of the springs, which is around the right side of the U-shaped rod. In the open position, the release tab is pressed into the side of the holster by the first spring. When the U-shaped rod is pressed toward the front of the holster, the locking tab moves with it, and at a certain point clears the ejection port slot of the holster body, and is caused by the spring to pass through the ejection port slot of the holster, which at that time is also lined up with the ejection port of the handgun. This allows the locking tab to pass through the ejection port of the slide and to contact the barrel of the handgun. After contacting the barrel of the handgun, when the handgun is released, the springs push the U-shaped rod and the locking tab toward the rear of the holster, and the side of the locking tab presses against the side of the ejection port slot of the holster body. Different handguns have different configurations, and in other handguns another feature of the handgun, preferably a feature on the slide, would be engaged. Once the handgun is released, it is locked in place until the releasing means is activated.

The user activates the releasing means by pressing down on the handgun. This causes the U-shaped rod to move toward the front of the holster and also moves the locking tab laterally. When the locking tab is moved sufficiently toward the front of the holster, it becomes clear of the ejection port of the handgun and may be lifted away from the handgun by the user's thumb or finger pressing down on the release tab. When this happens, the handgun may be removed from the holster. While the handgun is being removed from the holster, the release tab may be pressed down for a portion of the withdrawal by the thumb and/or finger as it slides over the release tab toward the rear of the holster.

A significant feature of the holster is that one spring is utilized to accomplish two actions. The first action is to urge the U-shaped rod toward the rear of the holster, and thus urge the handgun out of the holster. The second action is that the same spring applies a rotating or torsional force to the locking tab and pushes it toward the handgun.

Another feature of the security holster of the present invention is that the surface of the holster has one or more inlay receiving regions. Each inlay-receiving region is basically a recess in the holster's surface, surrounded by a raised edge. Into each of these recesses, an adhesive backed inlay may be placed. These inlays are the same depth as the recess so that the inlay does not extend above the surface of the holster. Due to the inlay receiving regions, the inner wall of the recess surrounds each edge of each inlay, and no inlay edge is exposed to wear. The result of this is that the recesses protect the inlays from wear, and the inlays do not tend to peel up at the edges. The purpose of the inlays is to allow the holster to receive a decorative surface to match the requirements of any particular gun user. For instance, one particular police department may require a certain style or finish on the accessories that the officers carry. In this way, a plastic holster can be covered with a decorative surface pattern, such as basket weave, to match the other accessories being carried by a police office. The inlays can also contain the insignia of an organization or artwork preferred by any particular user. The inlays can also be of a color chosen by the user and may contain reflective material to make the holster more visible at night.

A feature of all embodiments is an optional detachable overlay, which can be snapped into place on the holster of the invention. The overlay forms a protective shield around the release tab, and thus is a finger tube into which a user must place a portion of his/her finger in order to access the release tab. This feature restricts access to the release tab, and makes release of the handgun difficult for anyone other than the wearer of the holster.

One embodiment of the invention includes a release tab on the left side of the handgun. In this version, a locking means is configured to admit the handgun into the security holster. It is also adapted to engage a handgun feature of the handgun placed in the inner cavity of the security holster, thereby preventing the withdrawal of the handgun prior to release of said locking means.

This embodiment includes a releasing means located adjacent to said left side handle of the handgun for releasing the locking means by movement of a user's right thumb or left hand index finger. The releasing means is a release tab that is configured for engagement with the user's right thumb when a right-handed user reaches for, releases, and removes the handgun from the holster. The release tab is operationally connected to a locking tab. The release tab is activated by pressure of a user's right thumb or left hand index finger, which disengages the locking tab from said handgun feature when said release tab is depressed.

This embodiment of the security holster includes a release ramp that lifts the locking tab out of the ejection port when the locking tab moves forward. The release is connected to the locking tab by a rod that passes from the left side of the handgun to the right side of the handgun. The rod has one or more springs attached to it, which urges the linking rod toward the rear of the holster and urges the locking tab into engagement with the ejection port.

The purpose of the foregoing Abstract is to enable the United States Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive in nature.

DESCRIPTION OF THE PREFERRED EMBODIMENTS

Figure 1:
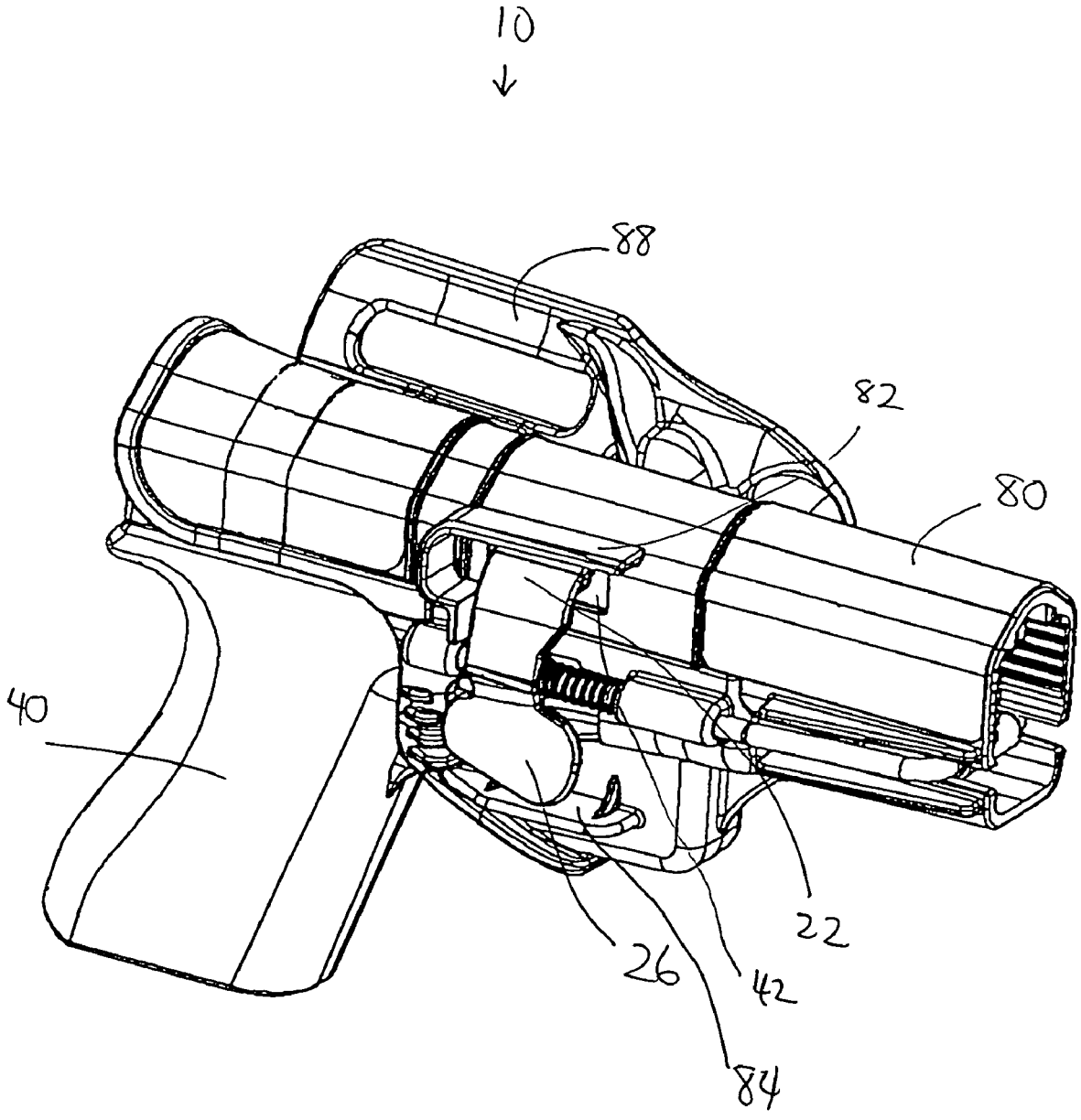
FIG. 1 is a perspective view of the holster of the invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Preferred embodiments of the security holster of the invention are shown in FIG. 1-4. FIG. 1 shows the security holster 10 of the invention and shows a holster inner shell 80. Also shown in FIG. 1 is a locking tab 22, a release tab 26, and a handgun 40. Also shown is a belt plate 88. Shown in FIG. 1 is a first ridge 82 which partially surrounds the locking tab 22 and the locking tab passage 42, through which the locking tab passes through the holster inner shell 80 and interacts with a feature of the handgun 40. Also shown in FIG. 1 is a second ridge 84, which partially surrounds the release tab 26. The first ridge 82 and second ridge 84 serve to protect the locking tab 22 and the release tab 26 from damage and inadvertent release. Since these two ridges project away from the holster inner shell 80, when pressure is applied to the area of the trigger guard of the handgun, which is adjacent to the release tab 26 and the locking tab 22, that pressure is likely to be applied to the distal edges of the first ridge 82 and the second ridge 84. This could happen when a person wearing the security holster 10 of the invention presses against a wall, or is lying on the ground.

The security holster 10 is preferably made of a high-impact plastic such as Kydex (Mfg. By Kleerdex Company). A thickness of ⅛ inch of this material has been found to be suitable for making the security holster. Other materials or thicknesses of materials that have similar characteristics of rigidity, strength, and weight would also be suitable. This might include metal such as aluminum, steel, other types of plastics, or leather. The security holster 10 is not limited strictly to handguns. In additional embodiments, the security holster 10 may be adapted to holster additional devices such as stun guns, tools or other instruments that could benefit from the features of the present invention. Other types of plastic can be used, as well as other materials such as leather or metal.

Figure 2:
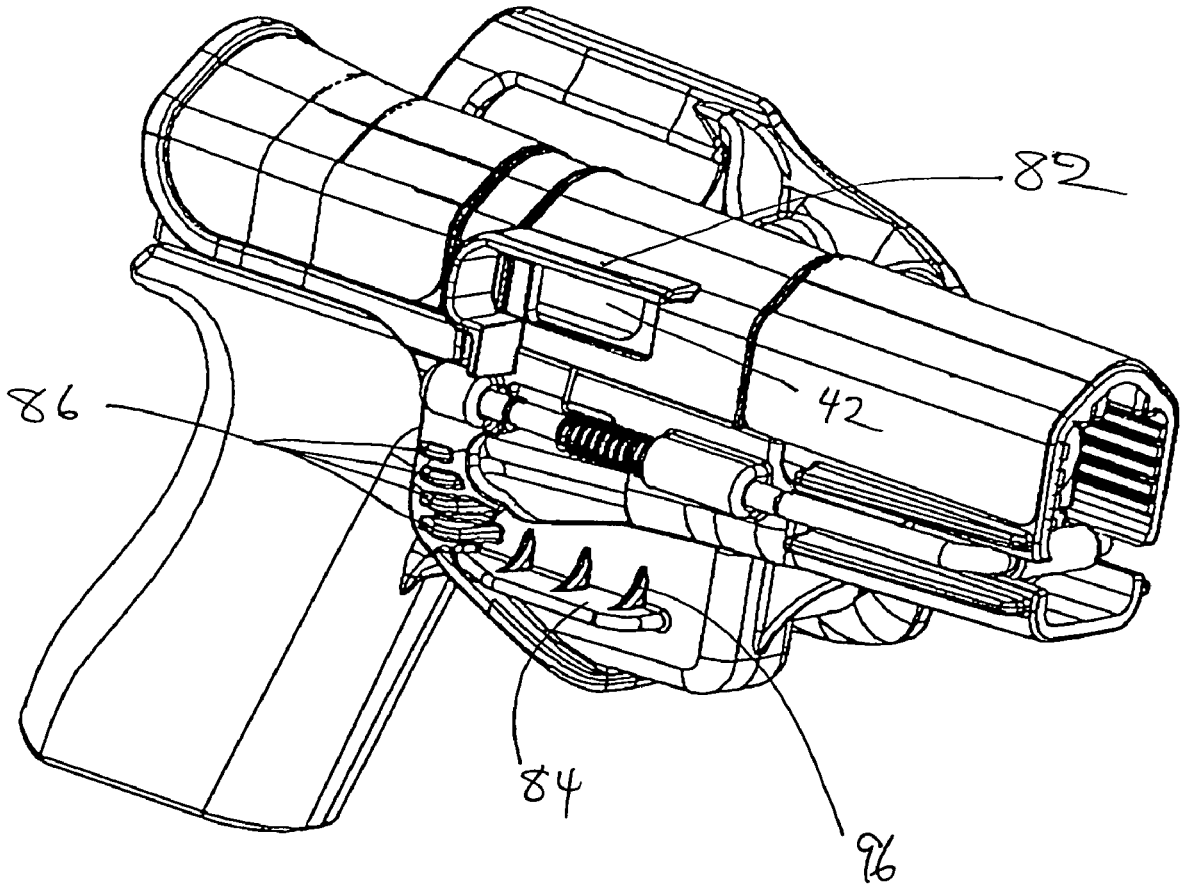
FIG. 2 is a perspective view of the holster of the invention.

FIG. 2 is a perspective view similar to FIG. 1, except the release tab and the locking tab are removed. This allows a better view of the first ridge 82 and the second ridge 84. As shown in FIG. 2, these ridges are preferably supported by a number of gussets 96. Also more clearly visible in FIG. 2 are a number of finger flare ridges 86. The distal edges of these finger flare ridges 86 together form a contour which provides a tactile map and cue for the user as he places his finger on the release tab 26 and prepares to release the handgun from the security holster. The finger flare ridges 86 also direct the user's finger to the flat surface of the release tab 26, so that his fingertip does not strike the leading edge of the release tab 26.

Figure 3:
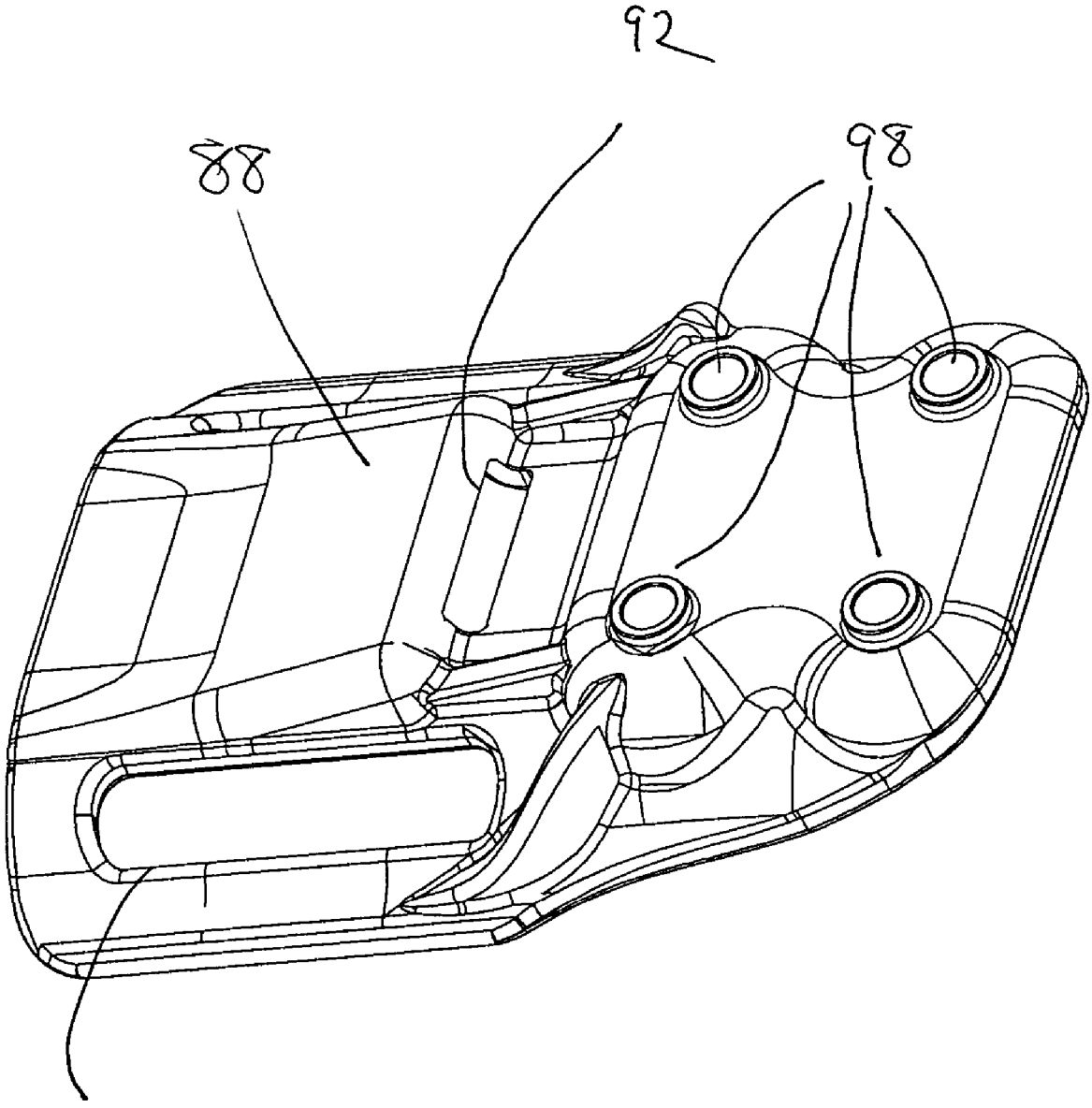
FIG. 3 is a perspective view of the belt plate of the holster of the invention.

FIG. 3 is a clearer version of the belt plate 88 on which the holster inner shell 80 is mounted. The belt plate 88 includes a belt plate mortise 92, which is a hole defined in the belt plate 88. The belt plate 88 also has a number of bolt passages 98 through which bolts pass in order to secure the holster inner shell 80 to the belt plate 88. The belt plate 88 also has belt loops 100, through which a user's duty belt can pass to assist in wearing the security holster.

Figure 4:
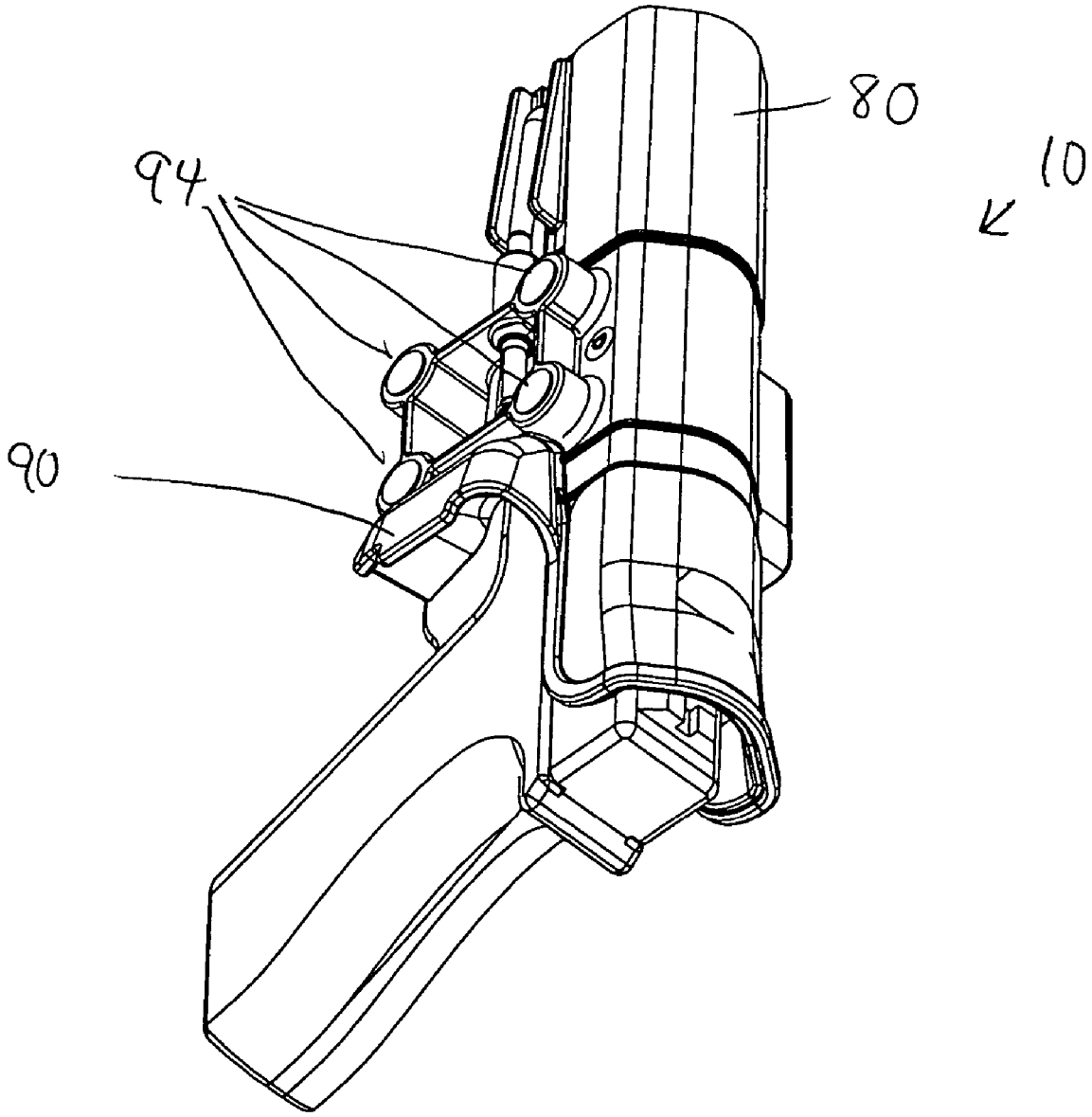
FIG. 4 is a perspective view of one aspect of the holster.

FIG. 4 is another view of the security holster 10 of the invention, showing a side of the holster inner shell 80, which shows a number of bolt receivers 94. These bolt receivers 94 interact with the bolt (not shown) which pass through the bolt passages 98 of FIG. 3, and securely lock the holster inner shell 80 to the belt plate 88. Also shown in FIG. 4 is a holster tenon 90. The holster tenon 90 passes through the belt plate mortise 92, which combines with the four bolt positions to provide a secure mounting of the holster inner shell to the belt plate 88.

Figure 5:
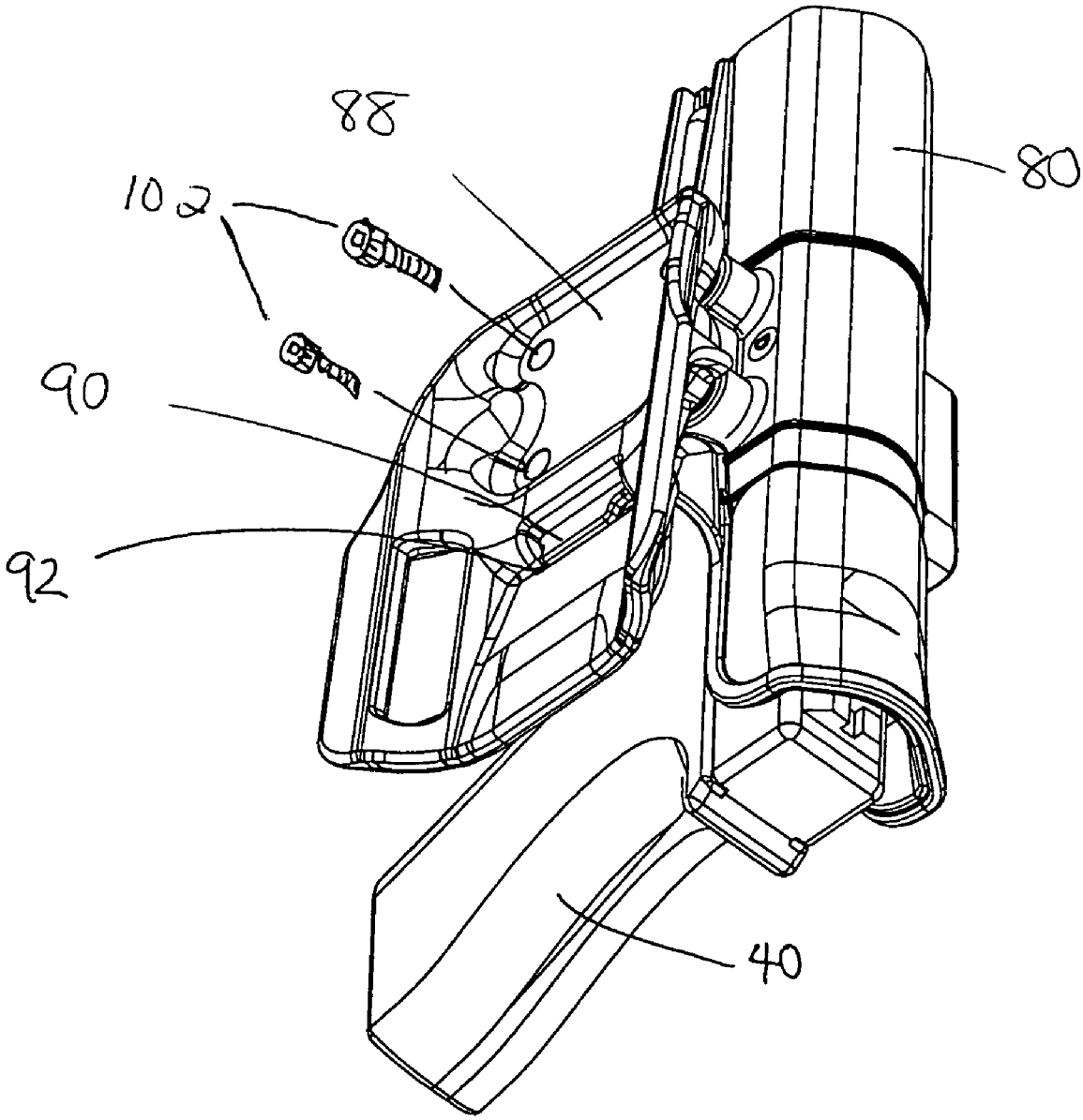
FIG. 5 is a perspective view of the holster of the invention.
Figure 6:
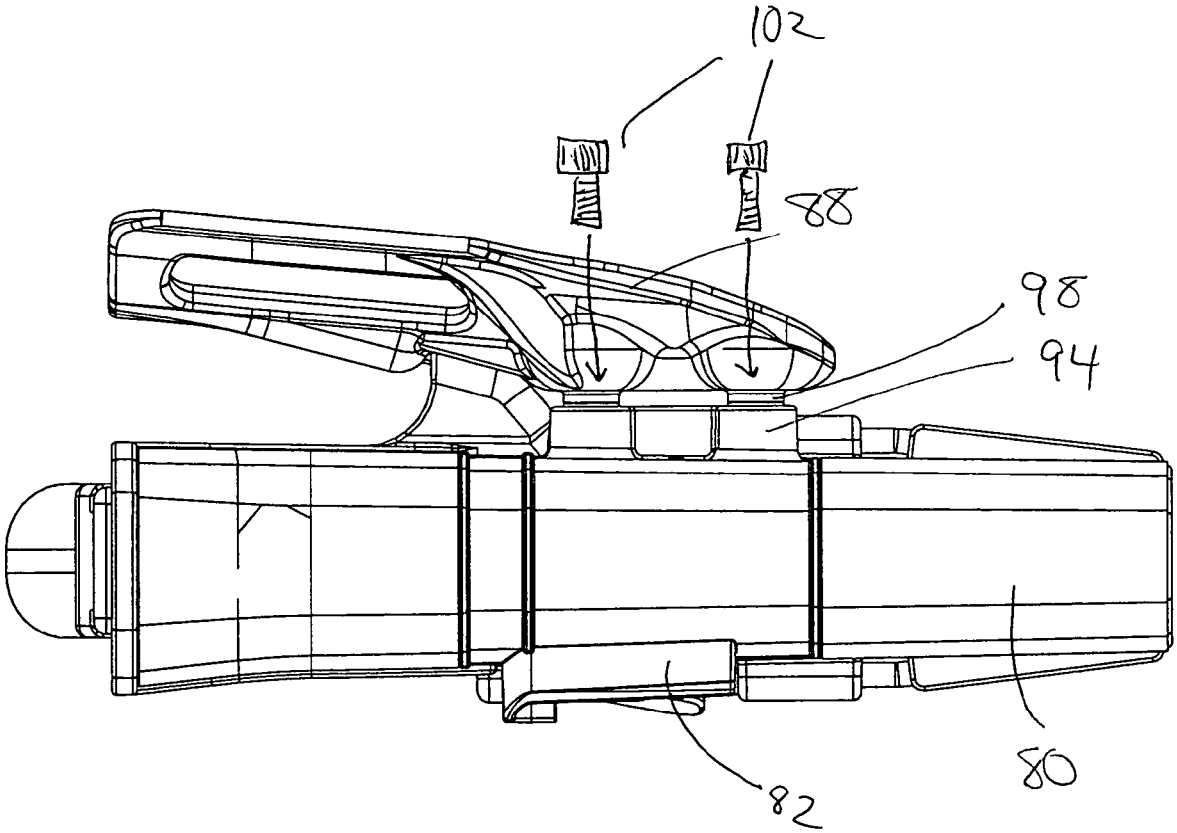
FIG. 6 is a top view of the holster of the invention.

FIG. 5 shows the belt plate 88 mounted to the holster inner shell 80, with the holster tenon 90 extending through the belt plate mortise 92. The bolt receivers 94 are engaged with bolt passages 98, for secure mounting by the use of bolts 102. FIG. 6 is another view showing the interfitting relationship of the belt plate 88 with the holster inner shell 80, with the bolt receivers 94 shown engaged with the bolt passages 98, and bolts 102.

The security holster of the present invention has various handgun retention features. The security holster of this invention utilizes a rigid holster body, which has a passage therein. A locking tab passes through the passage in the holster body and engages the ejection port of a semi-automatic handgun. The locking tab is mounted on a U-shaped tube and utilizes one or more springs, which urge it into engagement with the ejection port of the handgun. Operatively connected to the locking tab is a release tab, which is located over the trigger guard of the handgun. The location over the trigger guard of the handgun prevents the trigger of the handgun from being released during removal of the handgun from the holster.

One unique feature of this version of the security holster includes a first ridge, which is adjacent to the locking tab of the handgun. The first ridge is basically a wall-like projection that projects away from the holster body of the security holster, and is on one side or more of the locking tab. It can also partially surround the locking tab. It also functions as a safeguard for the locking tab. If pressure is accidentally applied to the entire side of the security holster, such as when the user might lay on the ground, the first ridge is raised so that such pressure is directed to the top of the first ridge, and not to the locking tab. In this way, the release tab is protected from inadvertent or accidental release. The invention also includes a second ridge, which is adjacent to and can partially surround the release tab of the handgun. The second ridge acts in a similar manner as the first ridge and the two ridge protect the locking and release mechanism from inadvertent pressure and accidental release.

Another feature of the handgun is a number of finger flare ridges which are located adjacent to the release tab. The finger flare ridges serve to direct a user's finger up and onto the release tab. By having the finger flare ridges present at the rear side of the release tab, the user's finger is prevented from striking the edge of the release tab, and is instead directed up over the edge and onto the top side of the release tab. This provides a tactile cue to the user for positioning his finger on the release tab. The finger flare ridges are a series of curved arcs, which project from the holster body and together form a shaped surface for positioning the user's finger. Another type of finger flare could be a bulge in the holster body itself or a buildup of material in that location in a similar shape.

These features are to be utilized in a security holster similar to that of the '824 application, which utilizes a U-shaped tube, a release tab, and a locking tab, which interfits into the ejection port of a handgun.

The purpose of the tab and slot of this embodiment of the holster is to provide increased strength to the holster. In use, the belt portion is firmly attached to a very heavy-duty belt worn around a police officer's waist. The holster body is attached to the belt portion. In a struggle for the weapon, an assailant might grab the handgun, which is secured in the holster body, and attempt to pull the handgun from the holster. This could involve a strenuous tug on the holster body from any direction. By providing the tab and slot structure located a distance away from the bolt positions, an additional physical structure is added to the holster body and the belt portion linkage. This increases its strength. Because the tab and slot arrangement are located a distance from the bolt attachment points, additional leverage is provided for resisting rotation of the holster body on the belt portion.

Besides slipping the tab into the slot, the union of the holster body with the belt portion can be additionally fortified by bolting or screwing through the belt portion into the slot. Additionally, a longer tab than that shown can be utilized, which extends into a slot. The slot can include a three or four-sided channel for making the union of the two pieces more secure. If the tab is longer, additional leverage is provided to resist rotation around the bolting positions. The tab can also be provided on the belt portion, with the slot on the holster body, and would function in the same way.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

We claim:

1. A security holster for use with a semiautomatic handgun, comprising:

a holster body comprising inner and outer spaced substantially rigid sidewalls joined along a top edge and a bottom edge and formed to define a generally handgun shaped inner cavity, with said handgun shaped inner cavity having a barrel end region, and an ejection port region adjacent to said outer sidewall, and a trigger guard region and an open top portion, with said holster body comprising a barrel end region opposite said open top portion, an ejection port region adjacent to said top edge, and a trigger guard region adjacent to said bottom edge, which correspond to said barrel end region, ejection port region and said trigger guard region of said handgun shaped inner cavity, said holster body further comprising a locking tab hingedly attached to said holster body adjacent said ejection port region and configured to be movable toward an interior of said handgun shaped inner cavity in said ejection port region of said handgun shaped inner space;

a release tab on an exterior surface of said holster body and functionally connected to said locking tab with said release tab attached to said holster body in the trigger guard region of said holster body and configured to move said locking tab away from said interior of said handgun shaped inner cavity in said ejection port region of said handgun shaped inner cavity;

a second ridge positioned on said holster body in the trigger guard region of said holster body adjacent to and partially surrounding said release tab, said second ridge having at least one planar side surface, said second ridge being completely bounded by a perimeter edge along which the second ridge is connected to and extends away from said holster body, said second ridge having a distal edge distal from said holster body, wherein the entire said perimeter edge is located between a lower end of said release tab and said bottom edge of said holster body, and wherein the second ridge extends away from said holster body sufficiently to protect said release tab of said holster from impact and subsequent accidental or inadvertent release when a user is in various bodily positions or being assaulted by an attacker, by presenting said distal edge of said second ridge to receive impact or pressure rather than said release tab.

2. The security holster of claim 1 which further comprises a first ridge positioned on said outer surface of said holster body in said ejection port region of said holster body and extending away from said holster body and adjacent to and partially surrounding said locking tab, said first ridge having a distal edge distal from said holster body, with said first ridge configured to protect said locking tab of said holster body with said distal edge of said first ridge configured to receive impact or pressure rather than said locking tab.

3. A security holster for use with a semiautomatic handgun, comprising:

a holster body comprising inner and outer spaced substantially rigid sidewalls joined along a top edge and a bottom edge and formed to define a generally handgun shaped inner cavity, with said handgun shaped inner cavity having a barrel end region, and an ejection port region adjacent to said outer sidewall, and a trigger guard region and an open top portion, with said holster body comprising a barrel end region opposite said open top portion, with said holster body comprising a barrel end region opposite said open top portion, an ejection port region adjacent to said top edge, and a trigger guard region adjacent to said bottom edge, which correspond to said barrel end region, ejection port region and said trigger guard region of said handgun shaped inner cavity, an ejection port region adjacent to said top edge, and a trigger guard region adjacent to said bottom edge, which correspond to said barrel end region, ejection port region and said trigger guard region of said handgun shaped inner cavity, said holster body further comprising a locking tab hingedly attached to said holster body adjacent said ejection port region and configured to be movable toward an interior of said handgun shaped inner cavity in said ejection port region of said handgun shaped inner space;

a release tab on an exterior surface of said holster body and functionally connected to said locking tab with said release tab attached to said holster body in the trigger guard region of said holster body and configured to move said locking tab away from said interior of said handgun shaped inner cavity in said ejection port region of said handgun shaped inner cavity;

a second ridge positioned on said holster body in the trigger guard region of said holster body and extending away from said holster body and adjacent to and partially surrounding said release tab, said second ridge having a distal edge distal from said holster body, with said second ridge extending away from said holster body sufficiently to protect said release tab of said holster from impact and subsequent accidental or inadvertent release when a user is in various bodily positions or being assaulted by an attacker, by presenting said distal edge of said second ridge to receive impact or pressure rather than said release tab; and a third projecting ridge in the form of a plurality of generally planar finger flare ridges, which project from the trigger guard region of said holster body, which together form a three dimensional finger flare shape between said trigger guard region of said holster body and said open top portion, to form a contoured surface comprised of distal edges of said finger flare ridges for deflecting and directing a user's finger up and over the edge of said release tab and onto said release tab.

* * * * *